US009419381B2

(12) United States Patent
Shimizu et al.

(10) Patent No.: US 9,419,381 B2
(45) Date of Patent: Aug. 16, 2016

(54) SHIELD CASE

(71) Applicant: Mitsubishi Electric Corporation, Tokyo (JP)

(72) Inventors: Yasuyuki Shimizu, Tokyo (JP); Takaaki Tanaka, Tokyo (JP); Hisakazu Yamane, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 42 days.

(21) Appl. No.: 14/621,626

(22) Filed: Feb. 13, 2015

(65) Prior Publication Data

US 2016/0104973 A1 Apr. 14, 2016

(30) Foreign Application Priority Data

Oct. 14, 2014 (JP) ..... 2014-209625

(51) Int. Cl.
*H01R 13/648* (2006.01)
*H01R 13/6581* (2011.01)

(52) U.S. Cl.
CPC ..... *H01R 13/6581* (2013.01)

(58) Field of Classification Search
CPC ..... H01R 12/596; H01R 13/6395
USPC ..... 439/98, 371, 373
See application file for complete search history.

(56) References Cited

U.S. PATENT DOCUMENTS 4,892,491 A * 1/1990 Budano, II ..... H01R 24/44 439/578
5,122,068 A * 6/1992 Koss ..... H01R 9/0512 439/785
5,545,848 A * 8/1996 Lin ..... H01R 9/0506 174/135
5,713,748 A * 2/1998 Mulvihill ..... H01R 9/053 439/579
6,297,447 B1 * 10/2001 Burnett ..... H01R 9/0524 174/40 CC
6,615,578 B2 * 9/2003 Yamazaki ..... B60K 6/445 180/309
6,623,303 B2 * 9/2003 Syed ..... H01R 13/6485 439/470
6,890,191 B1 * 5/2005 Thorburn ..... H01R 9/0524 439/607.41
6,953,897 B2 * 10/2005 Marroquin ..... H01R 13/655 174/75 C
7,749,015 B2 * 7/2010 Uchikawa ..... H01R 13/6395 439/362
7,850,478 B2 * 12/2010 Lin ..... H01R 13/6395 439/372
8,029,308 B2 * 10/2011 Saruwatari ..... H01R 13/6395 439/373
8,123,548 B2 * 2/2012 Grankvist ..... H01R 4/2412 439/394
8,613,629 B2 * 12/2013 Gong ..... H01R 13/6395 439/371
9,166,337 B2 * 10/2015 Boswell ..... H01R 13/6395
9,210,828 B2 * 12/2015 Liao ..... H05K 7/1492
2002/0068476 A1 6/2002 Kakinoki et al.

FOREIGN PATENT DOCUMENTS

JP 2001-273951 A 10/2001

* cited by examiner

*Primary Examiner* — Neil Abrams
(74) *Attorney, Agent, or Firm* — Sughrue Mion, PLLC

(57) ABSTRACT

An object of the present invention is to provide a shield case capable of applying shield to a connection portion by means of various versatile connectors. A configuration is made such that the shield case includes a lower case (8) to be mounted on a housing (3) of an electronic control device and an upper case (9) to be fitted into the lower case (8) with a harness (2) having a female connector (5) being nipped. In the shield case, the lower case (8) and the upper case (9) are fastened to the housing (3) by screws (10) with a shield conductor (7) of the harness (2) being nipped between the lower case (8) and the upper case (9).

14 Claims, 14 Drawing Sheets

SHIELD CASE

BACKGROUND OF THE INVENTION

1. Field of the Invention

The present invention relates to a shield case for connectors to be electrically connected to a harness used for transmitting a signal of an electronic control device.

2. Description of the Related Art

Hitherto, in a harness which is connected to an electronic control device and transmits a signal, when noise shield is particularly required, there has been generally used one which includes: wiring member (wire or cable) having a shielding function, for example, a shield wire or a shield conductor; and a connector which is connected to the wiring member and has shielding properties.

For example, in a D-subminiature (D-SUB) connector which is used for a personal computer and performs electrical communication, a connector case is assembled to a harness by screws or the like.

Further, in a harness side connector and a mating connector, the connectors can be fixed by being fastened to female screws of the mating connector by male screws provided on both sides of the harness side connector after pins are connected and grounding (GND) connection can be secured. Furthermore, this can be used in a state in which the harness and the connector case are integrally assembled by coupling the connector case to the harness by screws or the like. (For example, Patent Document 1)

Incidentally, the connector case described in Patent Document 1 does not have a shielding function; however, there is commercially available one in which a connector equipped with a metallic shield case is assembled in a harness having a shield wire or a shield conductor.

[Patent Document 1] Japanese Unexamined Patent Publication No. 2001-273951

By the way, there is one in which a versatile connector such as a vehicle-mounted water proof connector which is not shielded is provided with a locking mechanism for preventing from coming off due to vibration. When the shield case such as the above D-SUB connector is used by being integrally assembled to the harness equipped with the versatile female connector having the foregoing locking mechanism, the following problem exists.

First, when the female connector is arranged by being recessed from the design center of the shield case, the shield case comes in contact with a housing of the mating connector earlier and accordingly the connectors are likely not to be able to be fitted. In addition, stress is applied between the shield case and the housing of the mating connector after the connectors are fitted.

Conversely, when the female connector is arranged by being protruded from the design center of the shield case, the connectors are fitted earlier; however, the shield case separates from the housing of the mating connector and accordingly screw clamp becomes difficult.

Thus, whereas the D-SUB connector is positioned by only screws provided on the shield side, when a shield structure like the D-SUB connector is added to the harness equipped with the versatile connector having the locking mechanism, a positioning unit by means of a locking mechanism in which the connector itself has interferes with a positioning unit by means of a screw clamp and accordingly fitting and fixing cannot be properly made. Accordingly, a problem exists in that this cannot be used in a state in which the harness and the shield case are integrally assembled when the shield structure is applied to the harness equipped with the versatile connector having the locking mechanism.

BRIEF SUMMARY OF THE INVENTION

The present invention has been made to solve the problem described above, and an object of the present invention is to provide a shield case which can be mounted after a male connector and a female connector are assembled and is capable of applying shield to a connection portion by means of various versatile connectors.

A shield case according to the present invention includes: a metallic lower case to be mounted on a housing of an electronic control device; and a metallic upper case to be fitted into the lower case with a connector and a harness being nipped. In the shield case, the lower case and the upper case are fastened to the housing with a shield conductor of the harness being nipped, whereby the housing, the shield conductor of the harness, the lower case, and the upper case are electrically connected.

According to the present invention, the shield conductor of the harness is nipped and held by the lower case and the upper case and the lower case and the upper case are fastened to the housing of the electronic control device, whereby there can be obtained the shield case in which electrical connection can be secured among the housing, the shield conductor of the harness, the lower case, and the upper case; the shield case can be after-fitted after assembling of a male connector and a female connector; and a shielding function can be applied to a connection portion by means of various versatile connectors.

The foregoing and other objects, features, aspects, and advantages of the present invention will become more apparent from the following detailed description of the present invention when taken in conjunction with the accompanying drawings.

DETAILED DESCRIPTION OF THE INVENTION

Figure 1:
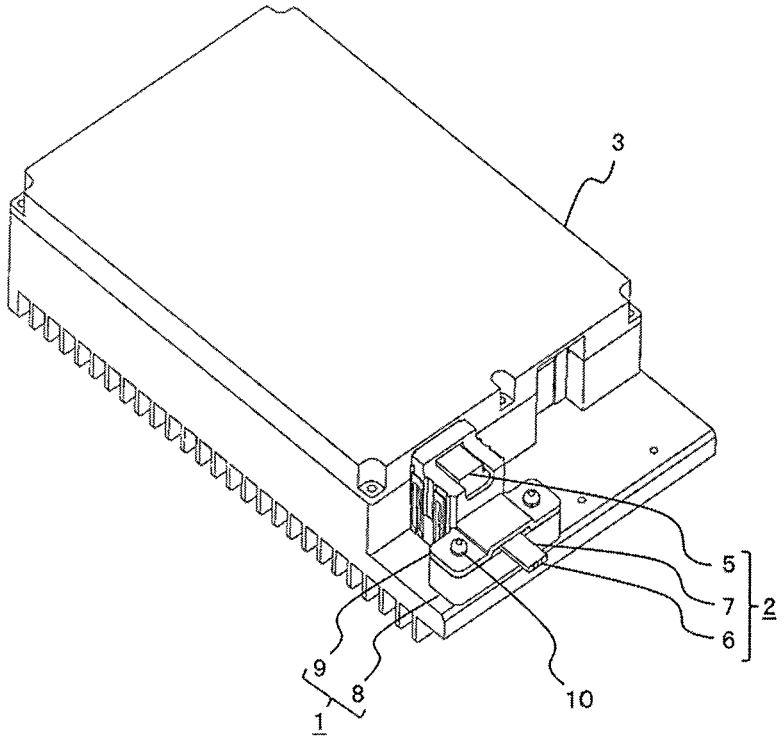
FIG. 1 is a perspective view showing a state in which a shield case and a harness are mounted on a housing of an electronic control device in Embodiment 1 of the present invention.

Hereinafter, the present invention will be described with reference to FIG. 1 to FIG. 12B of embodiments. Incidentally, in each of the following drawings, identical or equivalent members will be described with the same reference numerals assigned thereto.

Embodiment 1

Figure 2:
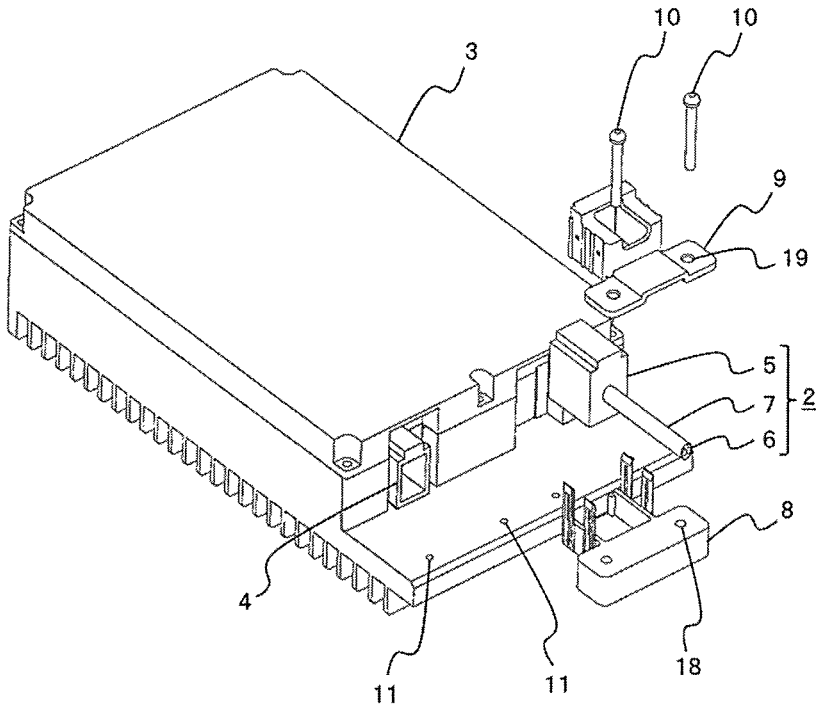
FIG. 2 is an exploded perspective view showing a state before mounting the shield case and the harness on the electronic control device in Embodiment 1 of the present invention.
Figure 3:
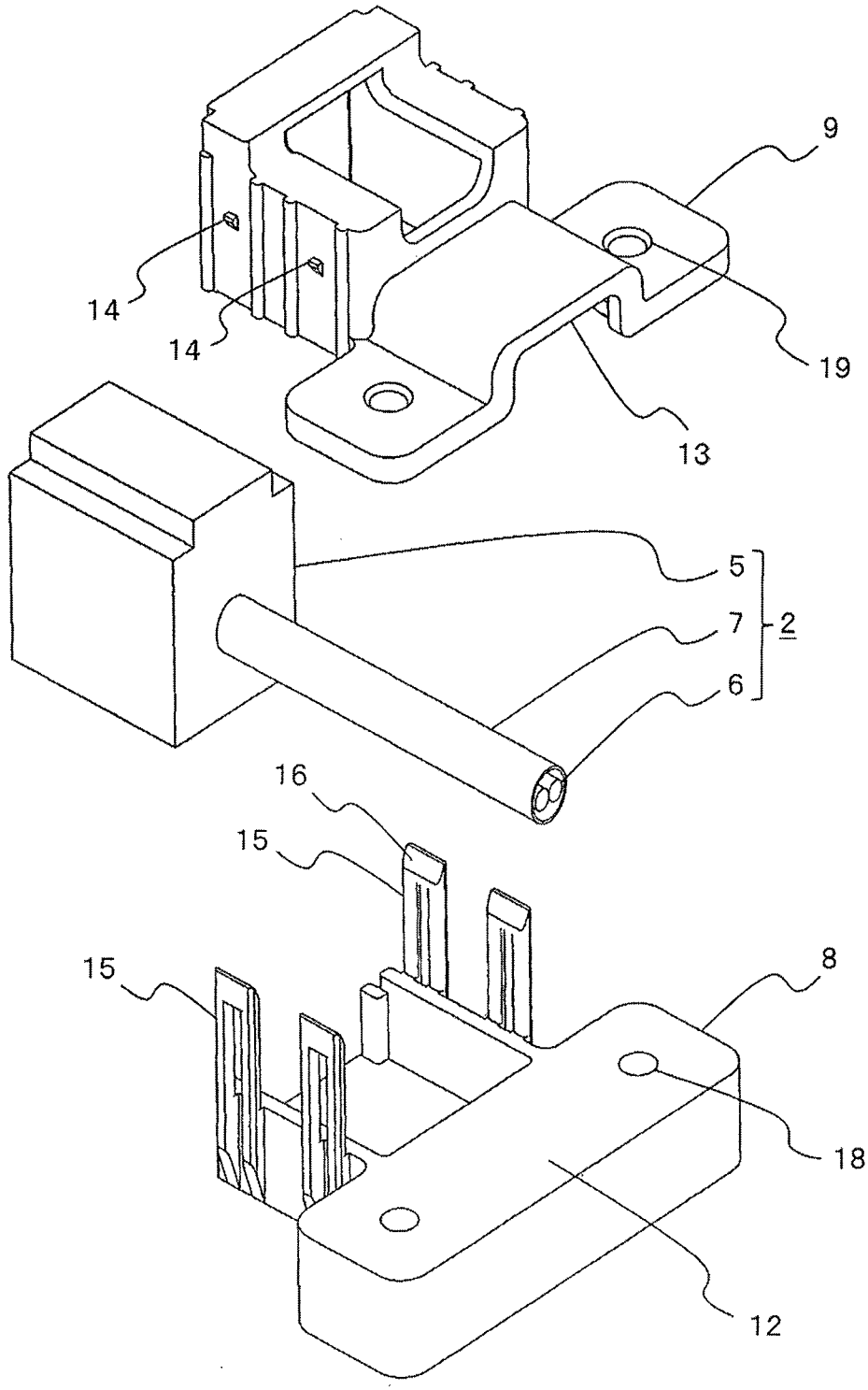
FIG. 3 is a perspective view showing the detailed structure of the shield case and the harness in Embodiment 1 of the present invention.
Figure 4:
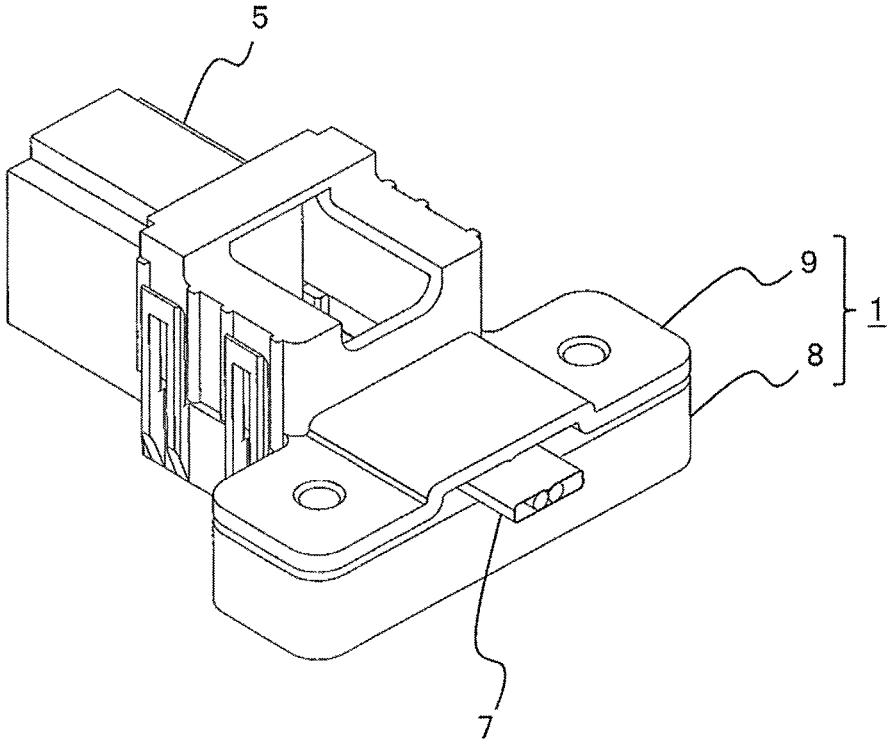
FIG. 4 is a perspective view showing a state in which an upper case of the shield case is integrally fitted into a lower case thereof with the harness being nipped therebetween in Embodiment 1 of the present invention.
Figure 5:
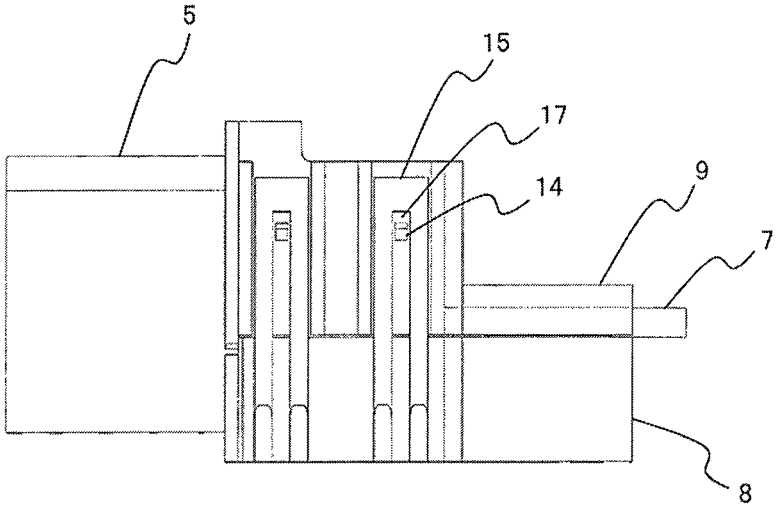
FIG. 5 is a side view showing a state in which the upper case of the shield case is integrally fitted into the lower case thereof with the harness being nipped therebetween in Embodiment 1 of the present invention.
Figure 6:
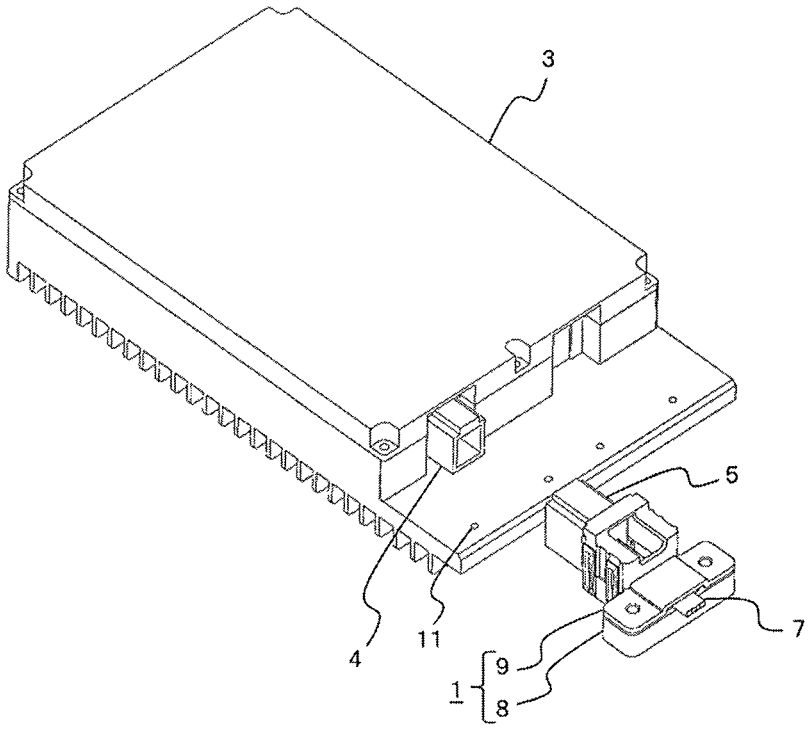
FIG. 6 is a perspective view showing a state before mounting the shield case and the harness on the housing of the electronic control device in Embodiment 1 of the present invention.
Figure 7:
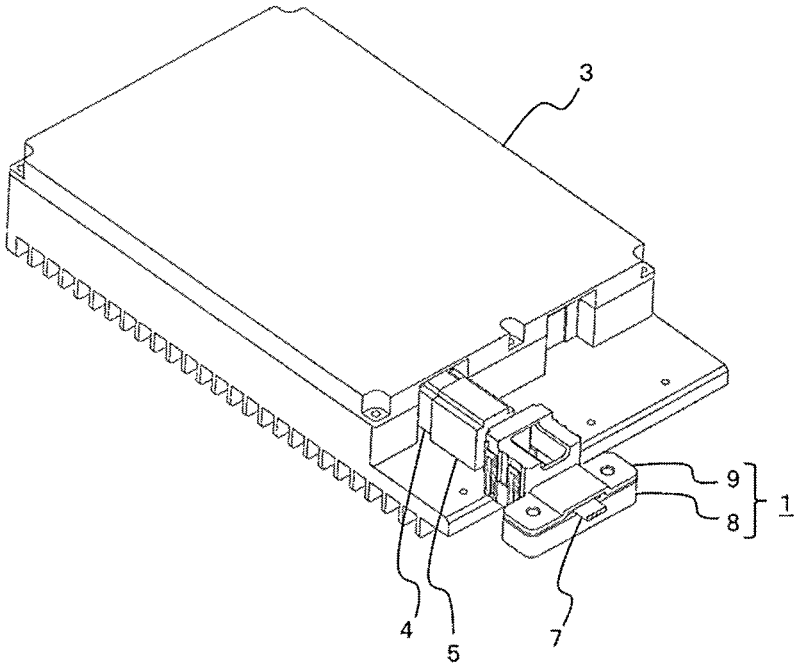
FIG. 7 is a perspective view showing a state in which the shield case and the harness are coupled to the housing of the electronic control device in Embodiment 1 of the present invention.
Figure 8:
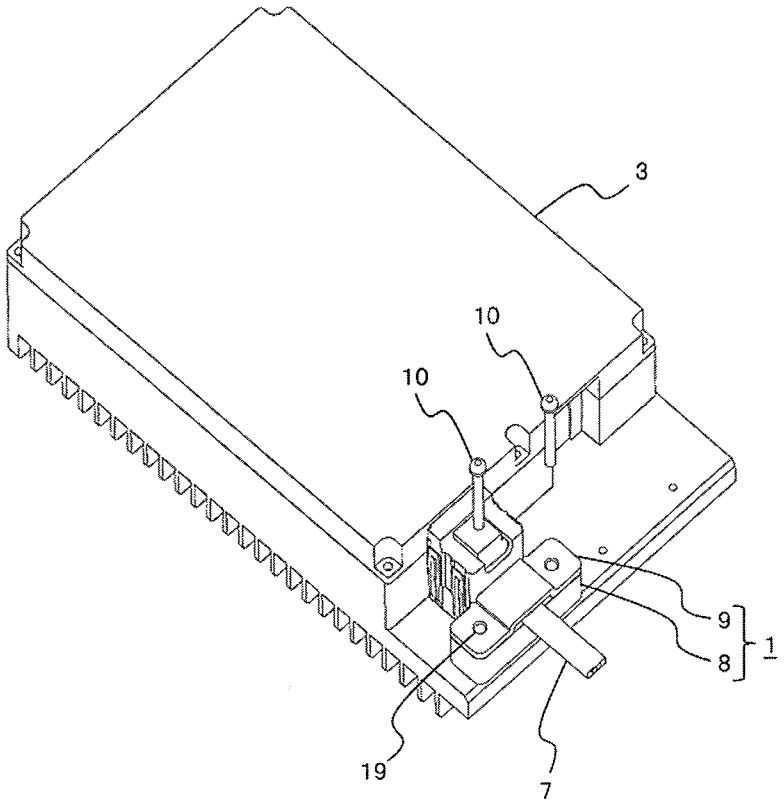
FIG. 8 is a perspective view showing a state before screw-fastening the shield case to the housing of the electronic control device in Embodiment 1 of the present invention.

FIG. 1 is a perspective view showing a state in which a shield case and a harness are mounted on a housing of an electronic control device in Embodiment 1 of the present invention; FIG. 2 is an exploded perspective view for explaining a state before mounting the shield case and the harness on the electronic control device in Embodiment 1 of the present invention; FIG. 3 is a perspective view showing the detailed structure of the shield case and the harness in Embodiment 1 of the present invention; FIG. 4 is a perspective view showing a state in which an upper case of the shield case is integrally fitted into a lower case thereof with the harness being nipped therebetween in Embodiment 1 of the present invention; FIG. 5 is a side view showing a state in which the upper case of the shield case is integrally fitted into the lower case thereof with the harness being nipped therebetween in Embodiment 1 of the present invention; FIG. 6 is a perspective view showing a state before mounting the shield case and the harness on the housing of the electronic control device in Embodiment 1 of the present invention; FIG. 7 is a perspective view showing a state in which the shield case and the harness are coupled to the housing of the electronic control device in Embodiment 1 of the present invention; and FIG. 8 is a perspective view showing a state before screw-fastening the shield case to the housing of the electronic control device in Embodiment 1 of the present invention.

In FIG. 1 to FIG. 3, a shield case 1 is metallic and is formed in a shape that covers a connector portion of a harness 2. On the other hand, a male connector 4 which is for connecting the harness 2 is provided in a housing 3 in which the electronic control device is placed. The harness 2 includes a female connector 5 connectable to the male connector 4, an insulation-covered wire 6 connected to the female connector 5, and a shield conductor 7 that surrounds the outer periphery of the wire 6. Furthermore, the shield case 1 is a two-divided structure including a lower case 8 to be mounted on the housing 3 of the electronic control device and an upper case 9 to be fitted into the lower case 8 with the harness 2 being nipped, and is mountably configured even after the male connector 4 is connected to the female connector 5.

Incidentally, the above description has been made on the case where the male connector 4 is provided on the housing 3 and the female connector 5 is provided on the harness 2. However, conversely, the female connector may be provided on the housing 3 and the male connector may be provided on the harness 2. Furthermore, the wire 6 is shown by two wires in the drawing, but may be shown by one wire or a plurality of wires and is not limited to two wires.

A shield case holding portion is formed on the housing 3 of the electronic control device. The shield case holding portion protrudes from the installation surface of the male connector 4 and has a width sufficient for mounting the shield case 1. The lower case 8 and the upper case 9 of the shield case 1 are fastened together by two screws 10 to screw holes 11 provided in the shield case holding portion of the housing 3 to be fixed to the housing 3.

At this time, the shield conductor 7 of the harness 2 is nipped between a harness holding portion 12 of the lower case 8 and a harness holding portion 13 of the upper case 9; and thus, the shield conductor 17 is crushed to be a shape extending to the right and to the left; and therefore, the housing 3, the shield conductor 7, the lower case 8, and the upper case 9 are electrically connected. Furthermore, the lower case 8 of the shield case 1 directly comes in contact with the housing 3 by fastening with the screws 10; and therefore, the connection distance from the shield conductor 7 to the housing 3 via the shield case 1 is shortened and the influence of noise on the electronic control device can be suppressed.

In this manner, the harness holding portion 12 of the metallic lower case 8 and the enlarged shield conductor 7 are connected by a face-to-face contact and the bottom surface of the lower case 8 and the shield case holding portion of the housing 3 are also connected by a face-to-face contact; and therefore, the connection between the shield conductor 7 and the housing 3 can be made in a wide area via the lower case 8.

Therefore, more reliable connection can be made as compared with connection by means of, for example, an earthing wire. Furthermore, the lower case 8 and the upper case 9 are fastened together to the housing 3 by the screws 10 with the shield conductor 7 being nipped; and thus, the harness 2 can be fixed and therefore an effect can be exhibited as also a countermeasure against vibration of the harness 2.

Two claws 14 are provided on each side of the upper case 9 of the shield case 1; and the claws 14 are made to engage with hooks 15 provided on both sides of the lower case 8 in a state in which the upper case 9 is fitted into between the claws 14 and the hooks 15; and thus, the lower case 8 and the upper case 9 of the shield case 1 are integrated as shown in FIG. 4 and FIG. 5. Incidentally, a tapered portion 16 that is cut to the inside is provided at a tip end portion of the hook 15; and the upper case 9 is inserted along the tapered portions 16 and thus fitting between the lower case 8 and the upper case 9 can be easily made. Furthermore, in a state in which the upper case 9 is integrally fitted into the lower case 8 with the shield conductor 7 being nipped, the shield case 1 is formed to dimensions that produce a gap 17 (shown in FIG. 5) between the claw 14 and the hook 15 to be formed in a state in which the shield case 1 is movable along the harness 2. The shield case 1 can be moved along the shield conductor 7 by the gap 17 between the claw 14 and the hook 15; and the gap 17 is set to a dimension having a distance at which the shield case 1 does not come off from the shield conductor 7.

Incidentally, the above description has been made on the case where two claws 14 and two hooks 15 are provided on each side of the upper case 9 and the lower case 8, respectively. However, in the case where one claw 14 and one hook 15 are provided on each side thereof, respectively, stability after fitting is deteriorated; and thus, it is better that two or more claws 14 and two or more hooks 15 are provided on each side thereof. Furthermore, the above description has been made on the case where the claw 14 is provided on the upper case 9 and the hook 15 is provided on the lower case 8. However, conversely, the configuration may be made such that the claw 14 is provided on the lower case 8 and the hook 15 is provided on the upper case 9.

Next, procedure for mounting the shield case 1 on the harness 2 and the housing 3 will be described with reference to FIG. 6 to FIG. 8.

First, as shown in FIG. 6, the upper case 9 of the shield case 1 is fitted into the lower case 8 thereof to be integrated in a state in which the shield conductor 7 of the harness 2 is nipped between the harness holding portion 12 of the lower case 8 and the harness holding portion 13 of the upper case 9. In this state, the gap 17 is present between the claw 14 and the hook 15; and therefore, the shield conductor 7 of the harness 2 is not fixed to the lower case 8 and the upper case 9, thereby becoming a state in which the shield case 1 is movable along the harness 2. In this state, as shown in FIG. 7, the female connector 5 of the harness 2 is fitted onto the male connector 4 provided on the housing 3 to be connected.

Next, as shown in FIG. 8, the shield case 1 is made to move to the mounting position of the housing 3; the screws 10 are inserted into mounting holes 19 of the upper case 9 and mounting holes 18 of the lower case 8 to be fastened to the screw holes 11 provided in the shield case holding portion of the housing 3; and the lower case 8 and the upper case 9 are fixed to the housing 3. The lower case 8 and the upper case 9 are fastened to the housing 3 with the screws 10; and thus, each gap between the lower case 8 and the upper case 9 disappears and the shield conductor 7 of the harness 2 is fixed by being nipped between the harness holding portion 12 of the lower case 8 and the harness holding portion 13 of the upper case 9. In this fixed state, the shield case 1 is metallic; and therefore, the housing 3, the shield conductor 7, the lower case 8, and the upper case 9 are electrically connected.

As described above, the shield case 1 can be moved to any position along the harness 2 in a state in which the upper case 9 is integrally fitted into the lower case 8; and after assembling of the male connector 4 and the female connector 5, the shield case 1 is after-fitted by moving to the connecting position by means of the connectors; and thus, interference or stress application between the shield case 1 and the housing 3 can be prevented. Therefore, there can be provided the shield case 1 capable of applying shield to various versatile connectors.

Embodiment 2

Figure 9A:
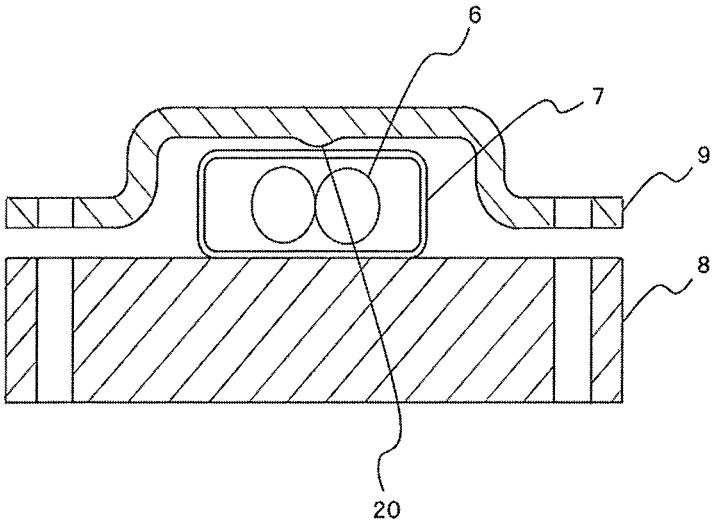
FIG. 9A is a sectional view showing a state before coupling of a shield case and a harness in Embodiment 2 of the present invention.
Figure 9B:
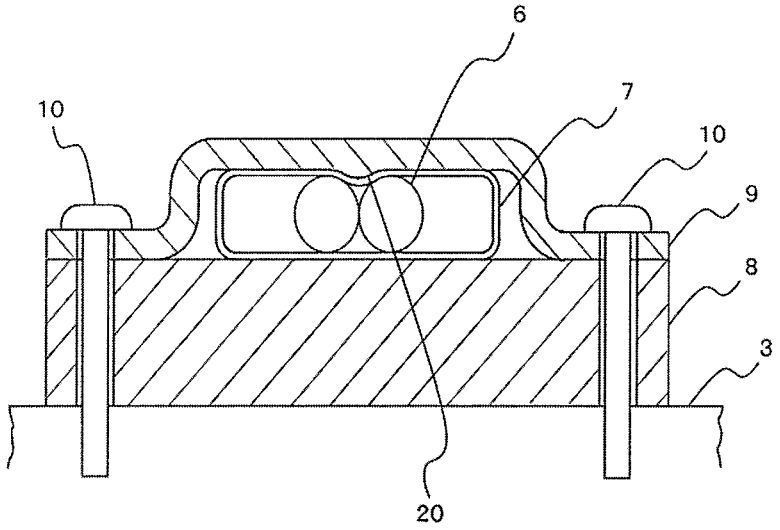
FIG. 9B is a sectional view showing a coupled state of the shield case and the harness in Embodiment 2 of the present invention.

FIG. 9A is a sectional view showing a state before coupling of a shield case and a harness in Embodiment 2 of the present invention; and FIG. 9B is a sectional view showing a coupled state of the shield case and the harness in Embodiment 2 of the present invention.

In the above-described Embodiment 1, the description has been made on the case where the shield conductor 7 of the harness 2 is nipped between the harness holding portion 12 of the lower case 8 of the shield case 1 and the harness holding portion 13 of the upper case 9 thereof to be fastened by the screws 10; and thus, the shield case 1 and the shield conductor 7 of the harness 2 are fixed to be electrically connected. However, in Embodiment 2, as shown in FIG. 9A, a configuration is made such that a protrusion 20 is further provided at a central portion of a harness holding portion 13 of an upper case 9.

The protrusion 20 is provided; and thus, as shown in FIG. 9B, when a lower case 8 and the upper case 9 are fastened together by screws 10, the protrusion 20 of the upper case 9 is pressed so as to eat into a shield conductor 7 and a harness 2 can be firmly fixed.

Incidentally, the protrusion 20 of the upper case 9 is not limited to one, but may be provided in a plural number; and the protrusion 20 may be provided at only the harness holding portion 12 of the lower case 8 or at both of the harness holding portion 12 of the lower case 8 and a harness holding portion 13 of the upper case 9. Furthermore, portions other than the above are similar to the configuration of Embodiment 1 and therefore the description thereof will be omitted.

Embodiment 3

Figure 10:
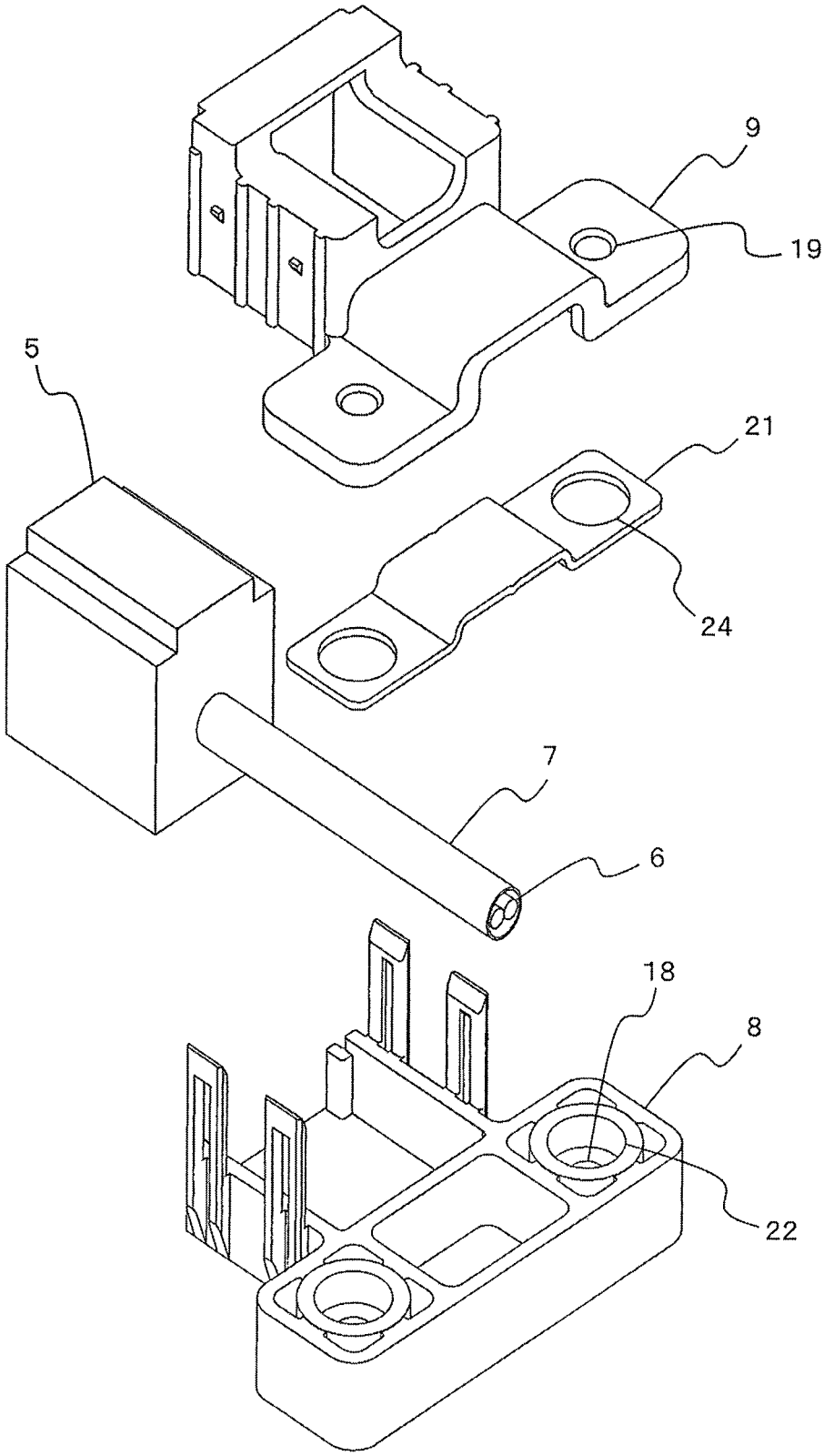
FIG. 10 is an exploded perspective view showing the detailed structure of a shield case and a harness in Embodiment 3 of the present invention.
Figure 11:
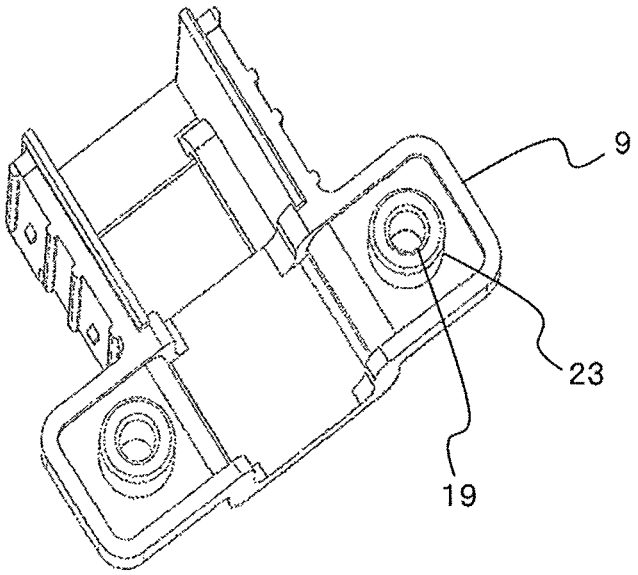
FIG. 11 is a perspective view in which an upper case of the shield case is seen from the inside direction thereof in Embodiment 3 of the present invention.
Figure 12A:
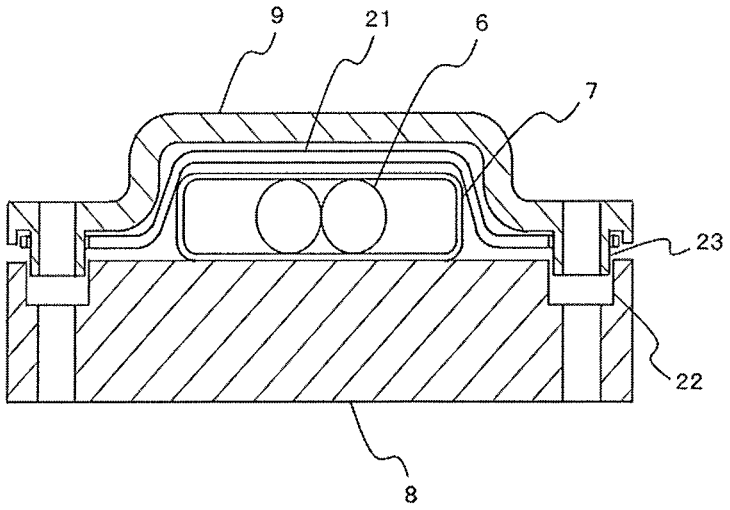
FIG. 12A is a sectional view showing a state before coupling of the shield case and the harness in Embodiment 3 of the present invention.
Figure 12B:
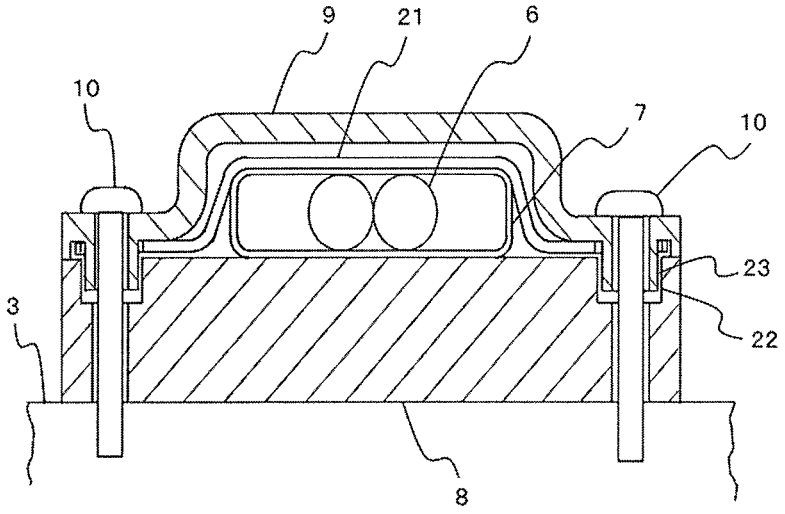
FIG. 12B is a sectional view showing a coupled state of the shield case and the harness in Embodiment 3 of the present invention.

FIG. 10 is an exploded perspective view showing the detailed structure of a shield case and a harness in Embodiment 3 of the present invention; FIG. 11 is a perspective view in which an upper case of the shield case is seen from the inside direction thereof in Embodiment 3 of the present invention; FIG. 12A is a sectional view showing a state before coupling of the shield case and the harness in Embodiment 3 of the present invention; and FIG. 12B is a sectional view showing a coupled state of the shield case and the harness in Embodiment 3 of the present invention.

In the above-described Embodiment 2, the description has been made on the case where the harness 2 is firmly fixed by providing the protrusion 20 on the harness holding portions 12 and 13 of the shield case 1. However, as shown in FIG. 10, a harness 2 may be fixed by inserting a clamp 21 between harness holding portions 12 and 13 of a shield case 1.

The clamp 21 is a material having spring properties and is formed in a shape along the harness holding portion 12 of an upper case 9. Furthermore, there is provided a boss hole 22 whose hole diameter on the upper case 9 side in a mounting hole 18 of a lower case 8 is enlarged. On the other hand, as shown in FIG. 11, a boss 23 in which the periphery of a mounting hole 19 is protruded is provided on the upper case 9. The height of the boss 23 is formed sufficiently higher than the gap 17 between the claw 14 and the hook 15 shown in FIG. 5. Furthermore, the clamp 21 is provided with a mounting hole 24 that is fitted onto the boss 23 of the upper case 9.

As shown in FIG. 12A, in a state in which the upper case 9 is fitted into the lower case 8, a gap, which corresponds to the gap 17 between the claw 14 and the hook 15 described in FIG. 5, is produced between the lower case 8 and the upper case 9. However, the mounting hole 24 of the clamp 21 is fitted onto the boss 23 provided on the upper case 9; and therefore, the clamp 21 is not come off.

Furthermore, as shown in FIG. 12B, in a state in which the lower case 8 and the upper case 9 are fastened to a housing 3 by screws 10, the clamp 21 has spring properties; and therefore, the clamp 21 is pressed to a peripheral portion of the boss 23 of the upper case 9 to press a shield conductor 7 of the harness 2 toward the lower case 8 and the harness 2 can be firmly fixed. Incidentally, portions other than the above are similar to the configuration of Embodiment 1 and therefore the description thereof will be omitted.

Incidentally, the present invention can freely combine the respective embodiments and appropriately change or omit the embodiments, within the scope of the present invention.

EXPLANATIONS OF REFERENCE NUMERALS

1: Shield case, 2: Harness, 3: Housing, 4: Male connector, 5: Female connector, 6: Wire, 7: Shield conductor, 8: Lower-case, 9: Upper case, 10: Screw, 11: Screw hole, 12: Harness holding portion, 13: Harness holding portion, 14: Claw, 15: Hook, 16: Tapered portion, 17: Gap, 18: Mounting hole, 19: Mounting hole, 20: Protrusion, 21: Clamp, 22: Boss hole, 23: Boss, and 24: Mounting hole.

What is claimed is:

1. A shield case comprising:

a metallic lower case to be mounted on a housing of an electronic control device; and a metallic upper case to be fitted into said lower case with a connector and a harness being nipped, wherein said lower case and said upper case are fastened to said housing with a shield conductor of said harness being nipped, whereby said housing, said shield conductor of said harness, said lower case, and said upper case are electrically connected.

2. The shield case according to claim 1, wherein said lower case and said upper case include a hook provided on one of said lower case and said upper case and a claw provided on the other side thereof, and said upper case is fitted into said lower case by engaging said hook with said claw.

3. The shield case according to claim 2, wherein said hook and said claw are configured so as to be engaged having a gap between said lower case and said upper case.

4. The shield case according to claim 2, wherein said hook and said claw are provided in a plural number on each side of said lower case and said upper case, respectively.

5. The shield case according to claim 3, wherein said hook and said claw are provided in a plural number on each side of said lower case and said upper case, respectively.

6. The shield case according to claim 1, wherein a configuration is made such that a protrusion is formed on said lower case or said upper case so as to press said shield conductor of said harness by the protrusion.

7. The shield case according to claim 2, wherein a configuration is made such that a protrusion is formed on said lower case or said upper case so as to press said shield conductor of said harness by the protrusion.

8. The shield case according to claim 3, wherein a configuration is made such that a protrusion is formed on said lower case or said upper case so as to press said shield conductor of said harness by the protrusion.

9. The shield case according to claim 1, further comprising a clamp having spring properties, said clamp being inserted between said lower case and said upper case.

10. The shield case according to claim 2, further comprising a clamp having spring properties, said clamp being inserted between said lower case and said upper case.

11. The shield case according to claim 3, further comprising a clamp having spring properties, said clamp being inserted between said lower case and said upper case.

12. The shield case according to claim 1, wherein said lower case and said upper case are fastened together and fixed to said housing by screws at both sides of holding portions with said shield conductor of said harness being nipped.

13. The shield case according to claim 2, wherein said lower case and said upper case are fastened together and fixed to said housing by screws at both sides of holding portions with said shield conductor of said harness being nipped.

14. The shield case according to claim 3, wherein said lower case and said upper case are fastened together and fixed to said housing by screws at both sides of holding portions with said shield conductor of said harness being nipped.

* * * * *